US006010131A

United States Patent [19]

Myers

[11] Patent Number: 6,010,131

[45] Date of Patent: Jan. 4, 2000

[54] MACHINE FOR VOIDING PLAYING CARDS

[75] Inventor: Brian Myers, Kansas City, Mo.

[73] Assignee: George C. Matteson Co. Inc., Blue Springs, Mo.

[21] Appl. No.: 09/114,676

[22] Filed: Jul. 13, 1998

[51] Int. Cl.[7] ..... A63F 1/06

[52] U.S. Cl. ..... 273/148 R; 463/29; 83/500

[58] Field of Search ..... 273/148 R, 138.2; 463/29; 83/500; 241/236

[56] References Cited

U.S. PATENT DOCUMENTS

| | | | |
|---|---|---|---|
| 3,788,180 | 1/1974 | Potsch et al. | 83/500 |
| 3,964,359 | 6/1976 | Westover | 83/500 |
| 4,965,983 | 10/1990 | Muller et al. | 83/500 |
| 5,067,309 | 11/1991 | Carlberg et al. | 83/500 |
| 5,609,337 | 3/1997 | Clapper, Jr. | 273/138.2 |

*Primary Examiner*—Benjamin H. Layno
*Attorney, Agent, or Firm*—Hovey, Williams, Timmons & Collins

[57] ABSTRACT

A machine (20) for voiding playing cards (30) utilizes a card receptacle (22), a feed apparatus (24), and rotary cutting implements (52, 54) to void playing cards (30) at high speed. The card receptacle (22) stacks the playing cards (30) substantially vertically above the feed apparatus (24), and the feed apparatus (24) includes feed belts (40) which repeatedly feed the bottom cards of the stack to the cutting implements (52, 54). Card movers (56, 57) are mounted adjacent to the cutting implements (52, 54) for rotation therewith and grip the cards (30) to move the cards (30) between the cutting implements (52, 54).

20 Claims, 3 Drawing Sheets

MACHINE FOR VOIDING PLAYING CARDS

BACKGROUND OF THE INVENTION

This invention relates to apparatuses and methods for voiding playing cards and, more particularly, to high speed machines and automated methods of voiding playing cards.

In the operation of gambling casinos, it is important to protect both the casinos and honest players from unscrupulous individuals willing to cheat at games of chance. Unfortunately, such individuals are as creative as they are unscrupulous and continually devise new methods for cheating. One tactic used by such individuals, is to bring additional cards into the casino. These additional cards are illegally introduced into casino games of chance to increase the cheaters' chances of winning.

To prevent the illegal introduction of such cards, casinos typically use playing cards with uniquely designed backs which are not available outside the casinos. Therefore, it is necessary to carefully control access to the casinos' playing cards. This becomes more difficult after playing cards have reached the end of their useful life, and the playing cards need to be discarded and replaced. To prevent discarded playing cards from being illegally introduced, casinos commonly void the cards by defacing them, so that they can be readily identified.

Discarded playing cards are commonly voided by drilling or punching a hole through the center of the cards. This process is typically performed by a manually operated drill press or punch which is capable of voiding only a limited number of cards at the same time. Therefore, the voiding process requires excessive time and labor.

Thus, it is desirable to increase the number of playing cards which can be voided in a given period of time. It is further desirable to reduce the manual labor required to void playing cards thereby reducing the costs of voiding cards.

BRIEF SUMMARY OF THE INVENTION

There is, therefore, provided in the practice of the invention a novel machine for voiding playing cards which operates at high speed to void playing cards in reduced time. The machine includes a card receptacle and voiding assembly attached to a support structure. The voiding assembly includes a cutting implement adjacent to the card receptacle to receive cards from the card receptacle.

In a preferred embodiment, a feed belt is attached to the support structure between the card receptacle and the cutting implement to feed cards from the card receptacle to the cutting implement. The card receptacle is a vertical card receptacle capable of holding a plurality of playing cards in a substantially vertical stack, and the feed belt is positioned at a bottom end of the card receptacle to take playing cards from the bottom of the stack.

Preferably, the cutting implement comprises a rotary cutting implement, and a second rotary cutting implement is positioned adjacent to the first cutting implement to form a cutting shear. The preferred embodiment also includes rotary card movers mounted on opposite sides of the cutting implements to move playing cards past the rotary cutting implements.

There is further provided in the practice of the invention a novel method for voiding playing cards. The method comprises stacking the playing cards, introducing the playing cards to the feed belt, feeding the playing cards from the stack to the cutting implement, and cutting playing cards with the cutting implement.

In a preferred embodiment, the playing cards are stacked substantially vertically and the playing cards are cut substantially linearly. Gravity is used to introduce the playing cards to the feed belt, and the cards are fed to the cutting implement by repeatedly feeding the bottom card of the stack to the cutting implement.

Accordingly, it is an object of the present invention to provide an improved machine for voiding playing cards which reduces manual labor and the time required to void playing cards.

It is a further object of the present invention to provide an improved method for voiding playing cards which reduces manual labor and the time required to void playing cards.

BRIEF DESCRIPTION OF THE DRAWINGS

These and other inventive features, advantages, and objects will appear from the following Detailed Description of The Preferred Embodiments when considered in connection with the accompanying drawings in which similar reference characters denote similar elements throughout the several views and wherein.

DETAILED DESCRIPTION OF THE PREFERRED EMBODIMENTS

Figure 2:
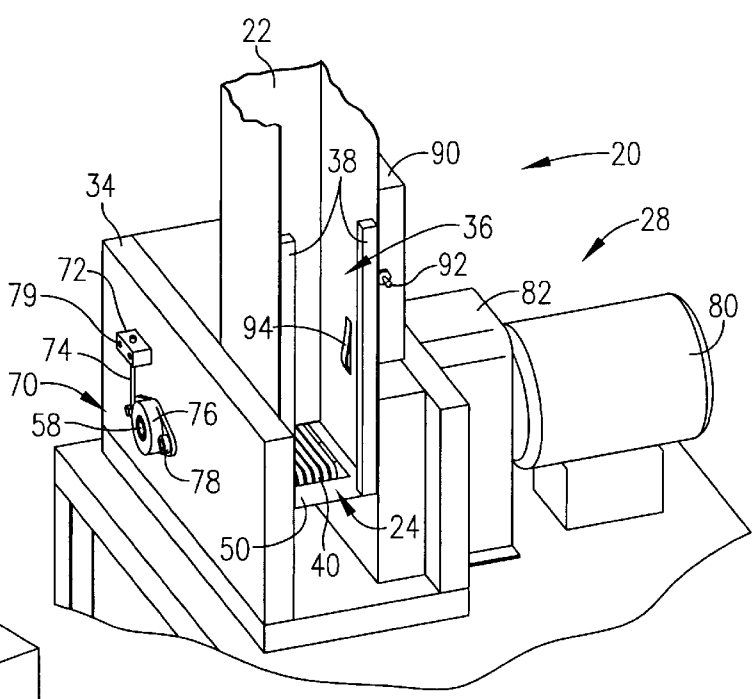
FIG. 2 is a rear fragmentary perspective view of the voiding machine of FIG. 1.
Figure 1:
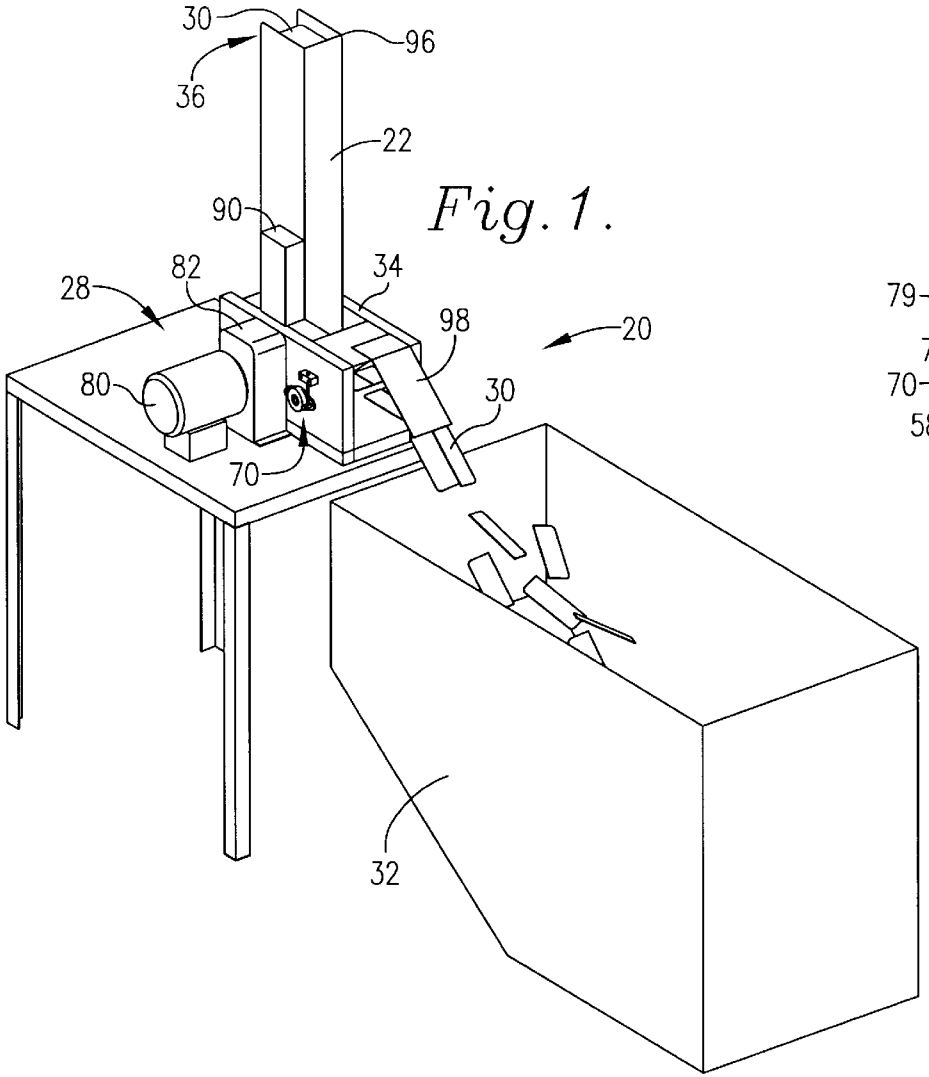
FIG. 1 is a front perspective view of a machine for voiding playing cards according to the present invention illustrating operation of the machine.

Referring to the drawings in greater detail, FIGS. 1 and 2 show a machine 20 for voiding playing cards. The machine 20 includes a card receptacle 22, a feed apparatus 24, a voiding assembly 26 (FIG. 5), and a drive assembly 28. A plurality playing cards 30 are stacked in the card receptacle 22, and the feed apparatus 24 feeds the cards 30 to the voiding assembly 26. The voiding assembly 26 cuts the cards 30 longitudinally, and the cut cards 30 are discharged into a waste container 32.

The card receptacle 22 extends into the top of a support structure 34. The support structure 34 also mounts the feed apparatus 24 and voiding assembly 26. The card receptacle is preferably vertically oriented and has a substantially rectangular configuration sized to receive playing cards 30. Thus, the playing cards are held in a substantially vertical stack by the card receptacle 22. The card receptacle has an open side 36 into which playing cards are inserted. The lower portion of the open side 36 includes inwardly extending flanges 38 which partially close the opening to inhibit inadvertent removal of the playing cards 30 from the lower portion of the card receptacle 22.

Figure 4:
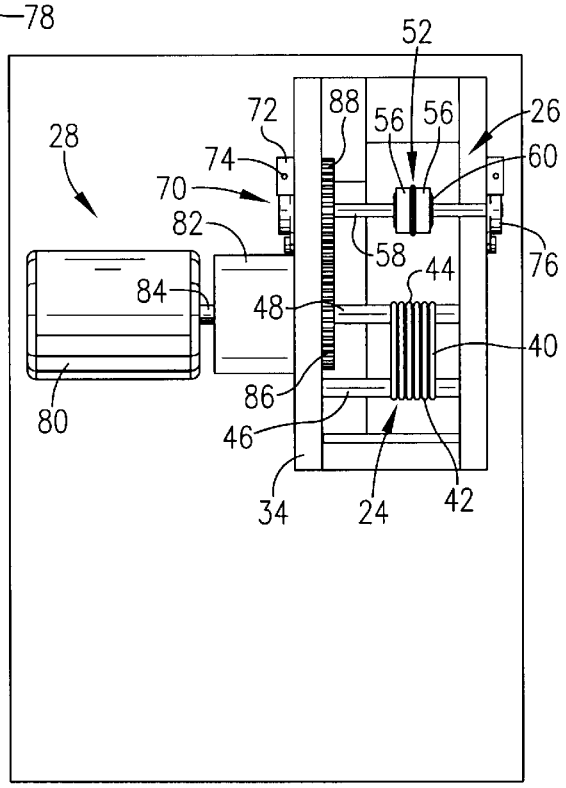
FIG. 4 is a top plan view of the voiding machine of FIG. 1 having portions thereof removed for illustration.

Referring to FIGS. 2 and 4, the feed apparatus 24 is mounted on the support structure between the card receptacle 22 and the voiding assembly 26, and the feed apparatus 24 preferably comprises a plurality of feed belts 40 elongated between upstream ends 42 and downstream ends 44. The belts 40 extend around an upstream idler shaft 46 and a downstream drive shaft 48 which is operatively coupled with the drive assembly 28. The feed apparatus is positioned below a bottom end of the card receptacle 22, and the belts 40 protrude upwardly through a bottom plate 50 of the card receptacle 22 to engage the playing cards held in the card receptacle. Thus, the feed apparatus is operatively positioned relative to the card receptacle 22 to take cards 30 therefrom.

Figure 5:
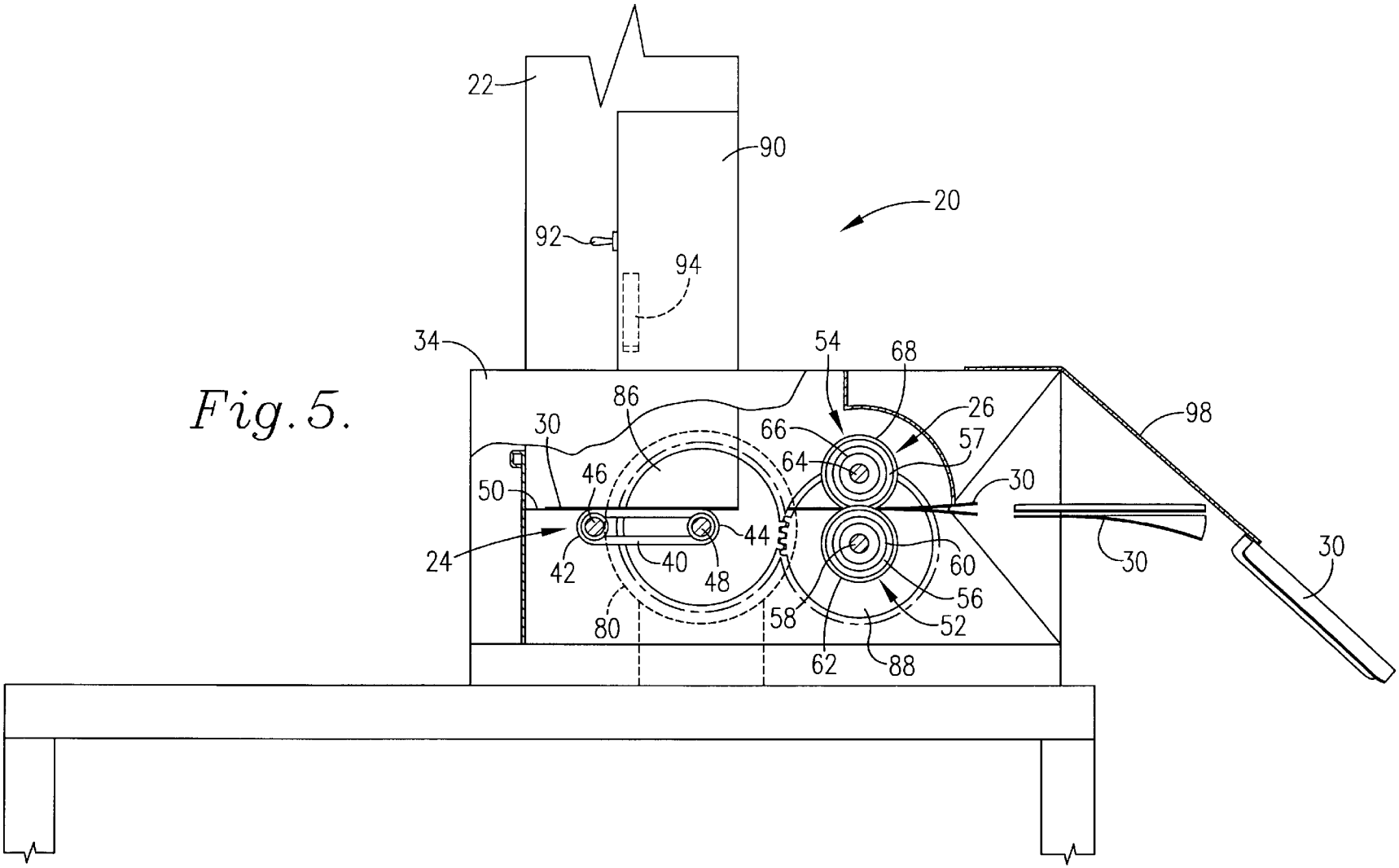
FIG. 5 is a side plan view of the voiding machine of FIG. 1 having portions thereof removed for illustration.

Referring to FIGS. 4 and 5, the voiding assembly includes a first rotary cutting implement 52, a second rotary cutting implement 54, and a plurality of rotary card movers 56. The first lower cutting implement 52 is mounted on a lower drive shaft 58 by an annular bushing 60, and two card movers 56 are mounted on opposite sides of the cutting implement 52. The lower cutting implement 52 has an outer, circular cutting edge 62 which preferably extends around the entire circumference of the cutting implement.

The second upper cutting implement 54 is mounted on an upper idler shaft 64 by an annular bushing 66 and also has two opposed card movers 57 (FIG. 5) mounted on either side of the cutting implement 54. The second cutting implement 54 also includes an outer circumferential cutting edge 68. The second cutting edge 68 and first cutting edge 62 are positioned adjacent to each other and overlap as shown in FIG. 5 to form a rotary shear. Alternatively, one of the cutting edges could be replaced with an anvil.

The card movers 56, 57 preferably comprise annular rubber rollers mounted on the outside of the annular bushings 60, 66 and rotate with the cutting implements to move cards past the voiding assembly 26. Preferably, the card movers 56 on the lower implement are spaced apart a predetermined distance from the card movers 57 (FIG. 5) on the upper implement sufficient to grip cards 30 and propel them through the voiding assembly 26. While the lower cutting implement 52 is rotated by the drive assembly 28, the upper cutting implement 54 is rotated by contact with the lower cutting implement 52. The cards passing between the cutting implements 52, 54 and card movers 56, 57 also operate to impart rotation from the lower cutting implement 52 to the upper cutting implement 54.

To adjust the overlap of the cutting edges 62, 68 and the spacing between the lower and upper card movers 56, 57 the lower drive shaft 58 is rotatably coupled with an adjustment mechanism 70 shown in FIG. 2. A fixed adjustment block 72 is attached to the support structure 34 and receives a slide rod 74 therethrough. The slide rod 74 is fixably connected to a rotary bearing 76 which receives the lower drive shaft 58 therein. The rotary bearing 76 is pivotally mounted to the support structure 34 at pivot point 78 which is opposite the slide rod 74. The slide rod 74 is selectively slidable in the fixed block 72. As the slide rod 74 slides longitudinally through the fixed block 72, the rotary bearing 76 pivots about the pivot point 78 causing the lower drive shaft 58 to move up and down relative to the upper idler shaft 64 thereby adjusting the relative positions of the first and second cutting implements 52, 54. Fasteners 79 are provided to lock the slide rod 74 in desired positions.

Figure 3:
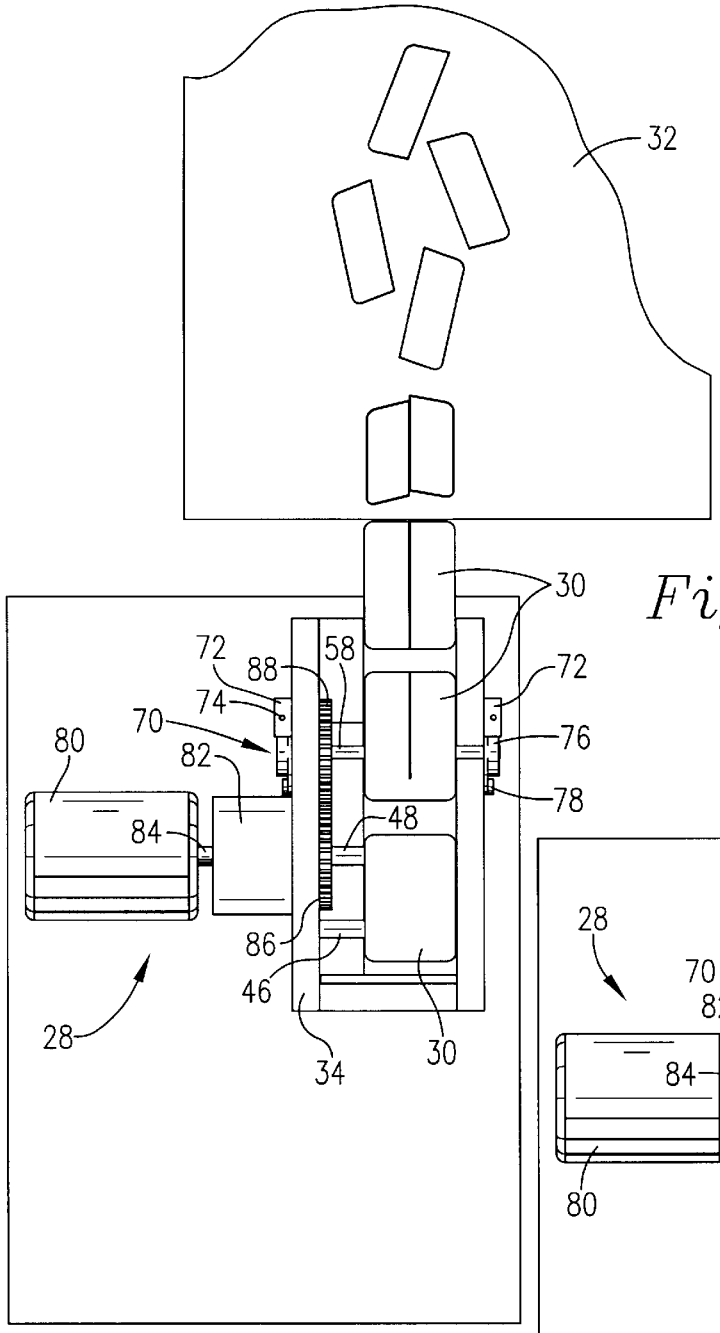
FIG. 3 is a top plan view of the voiding machine of FIG. 1 having portions thereof removed for illustration of the operation of the voiding machine.

Referring to FIGS. 2 and 3, the drive assembly 28 includes a motor 80 and a shaft housing 82 in which the motor shaft 84 is connected to the downstream drive shaft 48 of the feed apparatus 24. A drive gear 86 is connected to the downstream drive shaft 48 and engages a cutting gear 88 attached to the lower drive shaft 58 of the lower cutting implement 52, so that the drive assembly 28 is operatively coupled with the feed apparatus 24 and the voiding assembly 26. The cutting gear 88 is preferably smaller than the drive gear 86, so that the cutting implement 52 moves faster than and pulls cards away from the feed apparatus 24.

A control unit 90, best shown in FIGS. 2 and 5, is mounted on the support structure adjacent to the card receptacle 22. The control unit 90 includes an on/off switch 92 and an automatic shut off switch 94. The automatic shut off switch 94 is positioned near the bottom plate 50 of the card receptacle. When the stack of cards is sufficiently depleted, so that the cards 30 are all below the automatic shut off switch 94, the shut off switch 94 protrudes into the central opening of the card receptacle and the drive assembly 28 is shut off.

In operation, an operator inserts playing cards into the card receptacle until the stack of cards extends nearly to the top 96 of the card receptacle 22. The operator then turns on the motor 80 by depressing the on/off switch 92. The drive assembly then drives the feed apparatus 24 and rotates the cutting implements 52, 54 of the voiding assembly 26.

The card receptacle introduces the playing cards to the feed apparatus 24. The weight of the stack of cards creates a frictional force between the feed belts 40 and the bottom card of the stack allowing the belts 40 to grip the cards and feed them to the cutting implements 52, 54. Thus, gravity is utilized to introduce the playing cards to the feed apparatus 24. As the feeding operation continues, the bottom card in the stack is repeatedly gripped by the feed apparatus and fed to the cutting implements.

The feed apparatus 24 feeds the cards substantially centrally between the cutting implements 52, 54, and as the cards contact the cutting implements, they are engaged by the card movers 56 which grip the cards and pull them through the voiding assembly 26. Preferably, cards are singly introduced to the voiding assembly 26; however, the cards 30 may overlap or be introduced to the voiding assembly in small stacks. As the cards are pulled through the voiding assembly, the cutting edges 62, 68 shear the cards substantially linearly along the central longitudinal axes of the cards 30. The card movers 56 then discharge the voided cards from the machine 20. A deflector 98 is mounted on the machine to contact the cards as they are discharged from the machine 20, and direct the cards into the waste container 32. As the stack of playing cards is shortened, the operator simply loads additional playing cards into the card receptacle 22 through the open side 26 until all of the playing cards have been loaded.

Thus, a machine for voiding playing cards is disclosed which utilizes a feed apparatus and rotary cutting implements to void playing cards thereby reducing manual labor, cost, and the time required to void the playing cards. While preferred embodiments and particular applications of this invention have been shown and described, it is apparent to those skilled in the art that many other modifications and applications of this invention are possible without departing from the inventive concepts herein. For example, the illustrated vertical stack, card receptacle could be replaced with a conveyor assembly, card receptacle. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A machine for voiding playing cards to prevent players from illegally introducing cards into casino games of chance, the machine comprising:

support structure;

a card receptacle attached to the support structure for receiving playing cards to be voided;

a feed apparatus having a downstream end and an upstream end operatively positioned relative to the card receptacle to take playing cards from the card receptacle;

a voiding assembly attached to the support structure and including a cutting implement positioned adjacent to the downstream end of the feed apparatus to receive cards from the feed apparatus; and a drive assembly operatively coupled with the feed apparatus to drive the feed apparatus.

2. The machine according to claim 1 wherein the card receptacle comprises a vertical card receptacle having a substantially rectangular configuration for holding a plurality of playing cards in a substantially vertical stack.

3. The machine according to claim 1 wherein the feed apparatus comprises a plurality of feed belts elongated between the upstream and downstream ends.

4. The machine according to claim 1 wherein the feed apparatus is positioned at a bottom end of the card receptacle.

5. The machine according to claim 1 wherein the cutting implement comprises a rotary cutting implement including an outer circumferential cutting edge.

6. The machine according to claim 5 further comprising a second rotary cutting implement having a second outer circumferential edge.

7. The machine according to claim 6 wherein the second outer circumferential edge comprises a cutting edge adjacent and overlapping the first cutting edge to form a rotary shear.

8. The machine according to claim 5 wherein the drive assembly is operatively coupled with the cutting implement to rotate the cutting implement.

9. The machine according to claim 5 further comprising a first card mover adjacent the first cutting implement and a second card mover adjacent the second cutting implement, and the first and second card movers being operatively coupled with the drive assembly to drive the card movers whereby playing cards are moved past the cutting implements.

10. A machine for voiding playing cards to prevent players from illegally introducing cards into casino games of chance, the machine comprising:

support structure;

a card receptacle attached to the support structure for receiving playing cards to be voided;

a voiding assembly attached to the support structure and including a rotary cutting implement positioned relative to the card receptacle to receive cards from the card receptacle; and a drive assembly operatively coupled with the rotary cutting implement to rotate the rotary cutting implement.

11. The machine according to claim 10 further comprising a feed apparatus attached to the support structure between the card receptacle and the rotary cutting implement to feed playing cards from the card receptacle to the rotary cutting implement.

12. The machine according to claim 10 further comprising a rotary card mover adjacent to the rotary cutting implement for moving playing cards past the rotary cutting implement.

13. The machine according to claim 12 wherein the card mover comprises a rubber roller mounted adjacent to the cutting element for rotation therewith.

14. The machine according to claim 12 further comprising a second rotary card mover adjacent to the rotary cutting implement and the first and second card movers being positioned on opposite sides of the first rotary card mover.

15. An automated method for voiding playing cards with a machine including: a card receptacle, a feed apparatus, and a cutting implement to prevent players from illegally introducing cards into casino games of chance, the method comprising:

stacking a plurality of playing cards to form a stack of playing cards;

introducing the playing cards from the stack of playing cards to the feed apparatus;

feeding the playing cards from the stack of playing cards to the cutting implement;

cutting the playing cards with the cutting implement; and discharging the playing cards from the machine.

16. The method according to claim 15 wherein stacking the playing cards comprises substantially vertically stacking the playing cards, and cutting the playing cards with the cutting implement comprises substantially linearly cutting the playing cards with the cutting implement.

17. The method according to claim 15 wherein introducing the playing cards to the feed apparatus comprises introducing the cards to the feed apparatus with gravity.

18. The method according to claim 15 wherein feeding the playing cards to the cutting implement comprises repeatedly feeding a bottom card of the stack of playing cards to the cutting implement.

19. The method according to claim 15 further comprising rotating the cutting implement.

20. The method according to claim 19 wherein the machine further includes rotary card movers adjacent the cutting implement, and the method further comprises moving the playing cards past the cutting implement with the card movers.

* * * * *